US007780258B2

(12) United States Patent
Foo et al.

(10) Patent No.: US 7,780,258 B2
(45) Date of Patent: Aug. 24, 2010

(54) MEDIA SENSOR WITH POLARIZATION FILTER

(75) Inventors: Siang Leong Foo, Penang (MY); Yee Loong Chin, Perak (MY)

(73) Assignee: Avago Technologies ECBU IP (Singapore) Pte. Ltd., Singapore (SG)

( * ) Notice: Subject to any disclaimer, the term of this patent is extended or adjusted under 35 U.S.C. 154(b) by 216 days.

(21) Appl. No.: 11/871,388

(22) Filed: Oct. 12, 2007

(65) Prior Publication Data

US 2009/0096855 A1 Apr. 16, 2009

(51) Int. Cl.
*B41J 29/393* (2006.01)

(52) U.S. Cl. ..... 347/19

(58) Field of Classification Search ..... 347/14, 347/19, 106
See application file for complete search history.

(56) References Cited

U.S. PATENT DOCUMENTS 6,018,164 A * 1/2000 Mullens ..... 250/559.4
6,930,698 B2 * 8/2005 Goto et al. ..... 347/225

* cited by examiner

*Primary Examiner*—Lamson D Nguyen

(57) ABSTRACT

An apparatus for sensing a media type of a print medium. Embodiments of the apparatus include an emitter, a polarization filter, and a detector. The emitter is configured to emit light toward a surface of the print medium. The polarization filter is configured to filter polarized light reflected from the surface of the medium. The detector is coupled to the polarization filter and configured to detect the filtered light. The detector is also configured to generate an electrical signal representative of the detected light.

20 Claims, 7 Drawing Sheets

MEDIA SENSOR WITH POLARIZATION FILTER

BACKGROUND OF THE INVENTION

A media sensor is a device to determine different media types. A media sensor is typically used in a printing module so that the printing module may adjust the printing methods according to the media type of the print medium.

FIG. 1 depicts a schematic diagram of a conventional media sensing system 10. The conventional media sensing system 10 includes a conventional media sensor 12 and a print medium 14. The print medium 14 represents any type of media such as different types of printing paper. The conventional media sensor 12 includes an optical emitter 16 and two optical detectors 18 and 20. The optical emitter 16 generates light directed toward a surface of the print medium 14. The light is then reflected by the print medium 14 into specular and diffuse components. In FIG. 1, the specular reflection component is indicated by the solid arrows. Similarly, the diffuse reflection component is indicated by the dashed arrows, although the diffuse reflection component is reflected in a variety of directions.

As the print medium 14 is fed in (e.g., in the direction of the arrow), the optical detectors 18 and 20 detect the specular and diffuse reflectance components. In particular, the optical detector 20 is approximately at the specular reflection angle relative to the optical emitter 16 to detect the specular reflection component. The other optical detector 18 detects the diffuse reflection component of the reflected light. By converting the detected specular and diffuse reflection components to quantifiable values, the media type of the print medium is determined by comparing the values with known values for typical print media.

However, the resolution of the optical detector 16, or the ability of the optical detector 16 to differentiate among a variety of media types, is low because output ranges (i.e., diffuse and specular reflectance values) of different media overlaps significantly.

SUMMARY OF THE INVENTION

Embodiments of an apparatus are described. In one embodiment, the apparatus is an apparatus for sensing a media type of a print medium. Embodiments of the apparatus include an emitter, a polarization filter, and a detector. The emitter is configured to emit light toward a surface of the print medium. The polarization filter is configured to filter polarized light reflected from the surface of the medium. The detector is coupled to the polarization filter and configured to detect the filtered light. The detector is also configured to generate an electrical signal representative of the detected light. Other embodiments of the apparatus are also described.

Embodiments of a system are also described. In one embodiment, the system is a system to identify a media type of a print medium. Embodiments of the system include a media controller, a media sensor, and a processing device. The media controller is configured to feed the print medium in a direction. The media sensor is configured to generate an electrical signal indicative of the media type of the print medium. The electrical signal is based on at least a filtered component of polarized light reflected from a surface of the print medium as the print medium advances past the media sensor. The processing device is coupled to the media sensor. The processing device is configured to determine the media type of the print medium based on the electrical signal from the media sensor. The processing device is also configured to facilitate a print instruction specific to the media type of the print media. Other embodiments of the system are also described.

Embodiments of a method are also described. In one embodiment, the method is a method for identifying a media type of a print medium. An embodiment of the method includes emitting light toward a surface of the print medium at an angle of incidence to substantially polarize corresponding reflected light. The method also includes filtering the substantially polarized light. The method also includes detecting the filtered light. The method also includes determining a media type of the print medium based on the detected light. Other embodiments of the method are also described.

Other aspects and advantages of embodiments of the present invention will become apparent from the following detailed description, taken in conjunction with the accompanying drawings, illustrated by way of example of the principles of the invention.

BRIEF DESCRIPTION OF THE DRAWINGS

Throughout the description, similar reference numbers may be used to identify similar elements.

DETAILED DESCRIPTION

Figure 1:
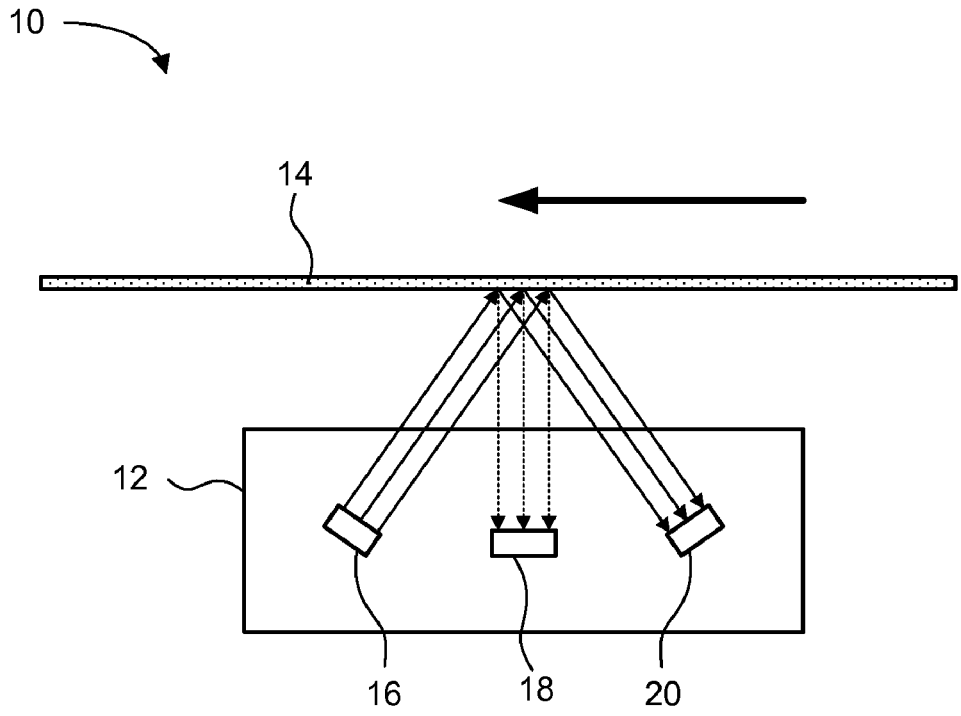
FIG. 1 (Prior Art)
FIG. 1 depicts a schematic diagram of a conventional media sensing system.
Figure 2:
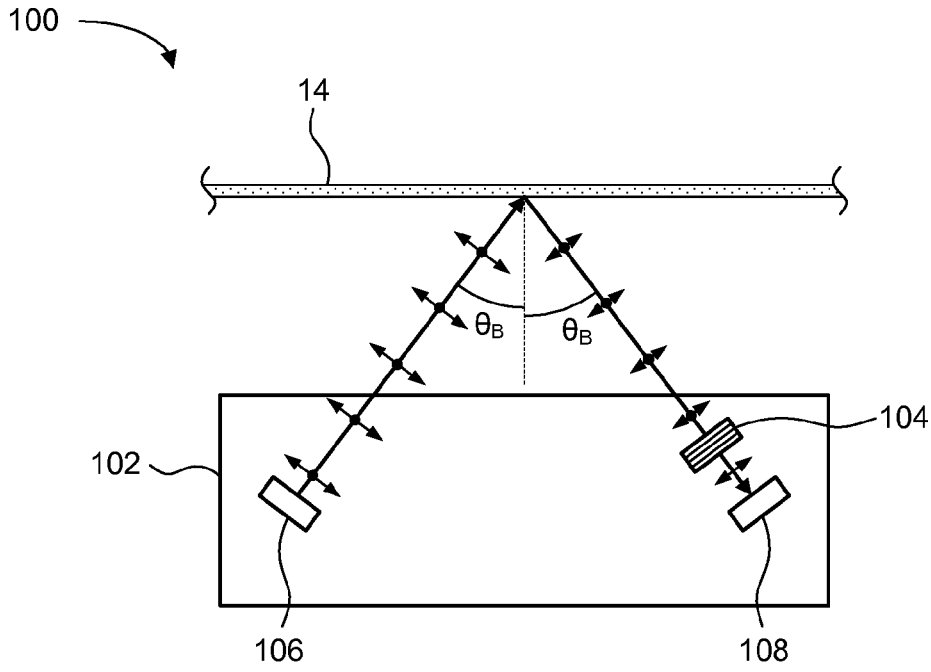
FIG. 2 depicts a schematic diagram of one embodiment of a media sensing system which implements a media sensor with a polarization filter.

FIG. 2 depicts a schematic diagram of one embodiment of a media sensing system 100 which implements a media sensor 102 with a polarization filter 104. The illustrated media sensor 102 also includes an optical emitter 106 and an optical detector 108. In general, the media sensing system 100 exhibits some basic concepts of media sensing using a polarization filter 104.

In one embodiment, the optical emitter 106 emits light toward a surface of the print medium 14. Various types of optical emitters 106 are known, including light emitting diodes (LEDs), and hence are not described in more detail herein. Although the distance between the optical emitter 106 and the surface of the print medium 14 is not specified, various embodiments may operate at different distances, according to known optical transmission principles. The emitted light is incident on and reflected by the surface of the print medium 14.

In one embodiment, the angle of incidence of the emitted light is approximately equal to Brewster's angle of the print medium 14. In general, Brewster's angle is the angle at which the reflected component of unpolarized incident light is polarized. One mathematical expression of Brewster's angle, which is based on Snell's law, is as follows:

$$\theta_B = \arctan\left(\frac{n_2}{n_1}\right),$$

where $\theta_B$ is Brewster's angle, and $n_1$ and $n_2$ are the refractive indices of the two media (e.g., air and the print medium 14) at the interface of the surface of the print medium 14.

It should be noted that unpolarized light is denoted as unpolarized because there is not a consistent polarization of the light. However, unpolarized light typically includes components that align with a particular direction of polarization. Hence, the component of the incident light that has perpendicular polarization (also referred to as s-polarization, from the German work "senkrecht" which means perpendicular) is reflected by the surface of the print medium 14. In contrast, at Brewster's angle, the component of the incident light that has parallel polarization (also referred to as p-polarization) is not reflected by the surface of the print medium 14.

By emitting unpolarized light (depicted by the cross arrows along the direction of transmission) toward the surface of the print medium 14 at approximately Brewster's angle of the print medium 14, the reflected light is substantially or completely s-polarized, since the other components (e.g., the p-polarized components) are not reflected much, if at all. However, it should be noted that the index of refraction of the print medium 14 is assumed to be unknown prior to detection of the media type of the print medium 14. Thus, an angle that approximates Brewster's angle for a variety of media types may be used, even though the reflected light may include some relatively small components that are not s-polarized. It should also be noted that the extent of polarization of the reflected light depends on the refractive index of the print medium 14, as well as the surface roughness of the print medium 14.

In one embodiment, the position and orientation of the optical emitter 106 is set to achieve an angle of incidence of approximately 58.7816 degrees. This is approximately the Brewster's angle for a print medium 14 with a refractive index of 1.65. However, other embodiments may have different refractive indices and/or angles of incidence. In some embodiments, the angle of incidence of the emitted light is between about 58 and 59 degrees. In another embodiment, the angle of incidence of the emitted light is between about 55 and 63 degrees. In other embodiments, the angle of incidence may correlate to a range of refractive indices between about 1.60 and 1.70. Other embodiments may use other refractive indices and/or angles of incidence.

The polarization filter 104 is oriented relative to the optical emitter 106 and the surface of the print medium 14 to filter out substantially all of the polarized light. In one embodiment, the polarization filter 104 is positioned and oriented at approximately Brewster's angle of the print medium 14, complementary to the position and orientation of the optical emitter 106. In this way, the print medium 14 polarizes substantially all of the reflected light, and the polarization filter 104 and the optical detector 108 receive the reflected light at an angle of reflection approximately equal to the Brewster's angle of the print medium 14.

As one example, the polarization filter 104 receives the reflected light, which includes an s-polarized light component (depicted by the dots along the reflected light ray of FIG. 2). The reflected light also may include unpolarized light (depicted by the cross arrows along the reflected light ray of FIG. 2), although the magnitude of the reflected unpolarized light is smaller than the unpolarized incident light. In particular, the reflected light includes unpolarized light when the angles of incidence and reflection are not exactly equal to the Brewster's angle of the print medium 14.

In one embodiment, the optical detector 108 generates an electrical signal commensurate with the magnitude of the light incident on the optical detector 108. Various types of optical detectors 108 are known, including photodiodes, and hence are not described in more detail herein. If the reflected light only includes an s-polarized light component, but does not include any unpolarized light, then the polarization filter 104 will nullify the reflected light by filtering out the s-polarized light component. Hence, the optical detector 108 will not generate an electrical signal because none of the reflected light is detected by the optical detector 108.

If the reflected light includes an s-polarized light component and unpolarized light, as shown in FIG. 2, then the polarization filter 104 filters out all of the s-polarized light component of the reflected light, but does not filter out the remaining unpolarized light. Hence, the optical detector 108 will generate an electrical signal based on the magnitude of the unpolarized light detected by the optical detector 108.

As another example, the composition of the reflected light may depend on the surface roughness of the print medium 14, as described above. For example, a mirror-finished print medium 14 reflects a high degree of s-polarized light. Hence, the optical detector 108 outputs a corresponding low output signal because the s-polarized light component is filtered out by the polarization filter 104. In contrast, a print medium 14 with a highly matte surface reflects a greater magnitude of unpolarized light, compared to the mirror-finished print medium 14. Hence, the optical detector 108 outputs a corresponding high output signal because the polarization filter 104 only filters out a relatively small s-polarized light component of the reflected light.

In another embodiment, the polarization filter 104 may be configured to filter out the p-polarized light component of the reflected light and to pass the s-polarized light component of the reflected light. For example, the axis of the polarization filter 104 may be oriented to be parallel with the direction of the s-polarized light component. Orienting the polarization filter 104 in the manner may change the dynamic range of the media sensor 102.

Using different values of the electrical signal generated by the optical detector 108, the media sensor 102 is capable of distinguishing between different types of media. In some embodiments, the amplitude of the electrical signal corresponds to the media type of the print medium 14. In other embodiments, another characteristic of the electrical signal may correspond to the media type of the print medium 14. Also, since the media sensor 102 may be used to detect the media type of print media with varying combinations of refractive indices and surface roughness, some embodiments of the media sensor 102 or a corresponding media sensing system may be pre-calibrated for several media types.

Figure 3:
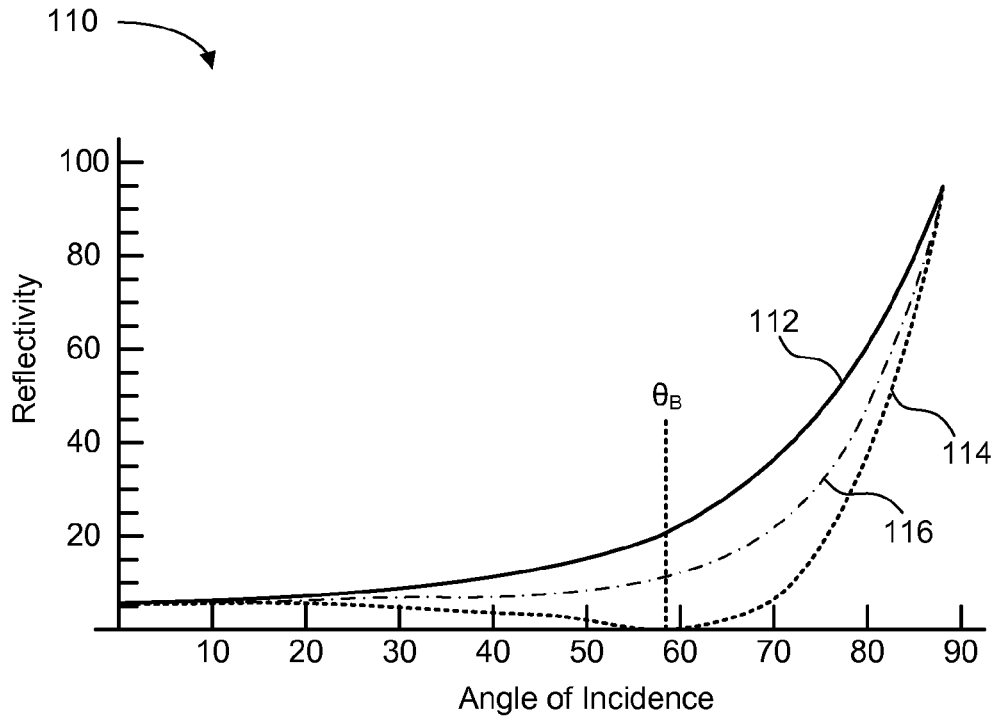
FIG. 3 depicts a schematic graph of one embodiment of media reflectivity versus angle of incidence.

FIG. 3 depicts a schematic graph 110 of one embodiment of media reflectivity versus angle of incidence. In particular, the graph 110 shows reflectivity along the vertical axis and angle of incidence along the horizontal axis for a refractive index ratio of 1.65 (i.e., $n_2/n_1=1.65$). More specifically, the graph 110 shows a first reflectivity curve 112 (shown as a solid line) to illustrate the approximate reflectivity of the s-polarization light for a range of angles of incidence. Similarly, the graph 110 shows a second reflectivity curve 114 (shown as a dashed line) to illustrate the approximate reflectivity of the p-polarization light for a range of angles of incidence. Also, the graph 110 shows a third reflectivity curve 116 (shown as a dashed-dotted line) to illustrated the approximate average reflectivity of the reflected light.

It can be seen from the graph 110 that the reflected light does not include a p-polarization light component at the Brewster's angle (e.g., 58.7816 degrees) of the print medium 14. Thus, at the Brewster's angle of the print medium 14, the polarization filter 104 filters out all of the s-polarized light component of the reflected light so that the optical detector 108 does not measure any reflected light. At angles other than the Brewster's angle, the optical detector 108 will detect the p-polarized light component of the reflected light and generate an output signal which correlates to the magnitude of the detected light.

Figure 4:
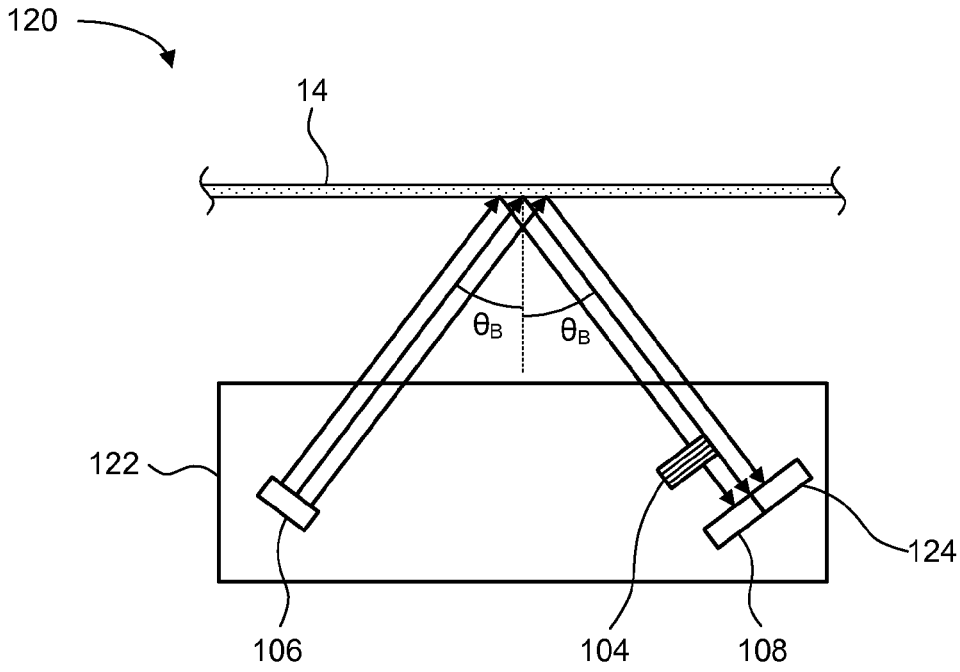
FIG. 4 depicts a schematic diagram of another embodiment of a media sensing system which implements a media sensor with multiple optical detectors.

FIG. 4 depicts a schematic diagram of another embodiment of a media sensing system 120 which implements a media sensor 122 with multiple optical detectors 108 and 124. In particular, both of the optical detectors 108 and 124 are positioned and oriented approximately at the Brewster's angle of the print medium 14 (or an equivalent calibration medium at about the average of a group of various media types). In this way, both of the detectors 108 and 124 are essentially in the path of the reflected light.

In the illustrated embodiment, the polarization filter 104 is aligned with one of the optical detectors 108. Hence, the detector 108 with the polarization filter 104 detects the filtered light, if any, that passes through the polarization filter 104. In contrast, the other optical detector 124 does not have a polarization filter and, hence, receives and detects all of the components of the reflected light.

By implementing multiple optical detectors 108 and 124 with and without a polarization filter 104, the optical detectors 108 and 124 generate and output electrical signals with different ranges. By correlating the multiple output signals to known values for various media types, the media sensor 120 or a corresponding media sensing system determines the media type of the print medium 14.

Figure 5:
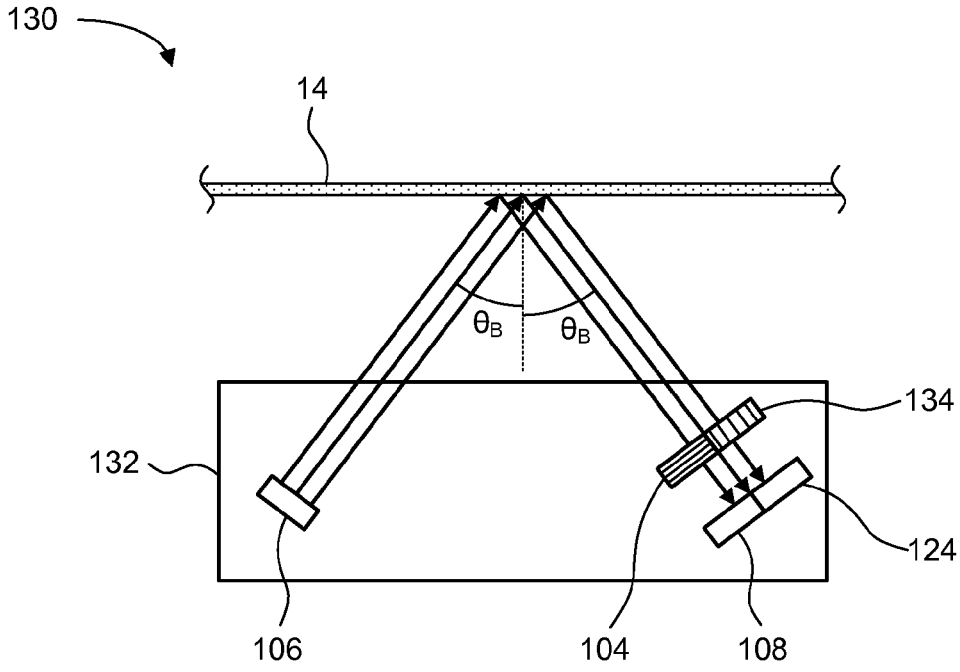
FIG. 5 depicts a schematic diagram of another embodiment of a media sensing system which implements a media sensor with multiple polarization filters.

FIG. 5 depicts a schematic diagram of another embodiment of a media sensing system 130 which implements a media sensor 132 with multiple polarization filters 104 and 134. In particular, the media sensor 132 includes polarization filters 104 and 134 for each of the optical detectors 108 and 124.

In the illustrated embodiment, the polarization filter 104 is aligned with the optical detector 108, similar to the embodiments described above. Similarly, the other polarization filter 134 is aligned with the other optical detector 124. It should be noted that all of the illustrated polarization filters 104 and 134 and optical detectors 108 and 124 are approximately located in the specular reflection path of the reflected light.

In one embodiment, the first polarization filter 104 is oriented perpendicular to the s-polarized light component to block, or filter out, the s-polarized light component. Hence, the first polarization filter 104 and the corresponding optical detector 108 operate in a substantially similar manner to the embodiments described above. In contrast, the second polarization filter 134 is oriented parallel to the s-polarized light component to pass the s-polarized light component to the corresponding optical detector 124. Hence, the second optical detector 134 operates to detect the magnitude of the s-polarized light component reflected from the surface of the print medium 14 and to generate an electrical signal corresponding to the detected s-polarization light component of the reflected light.

By implementing multiple optical detectors 108 and 124 with corresponding polarization filters 104 and 134, the optical detectors 108 and 124 generate and output electrical signals with different ranges. By correlating the multiple output signals to known values for various media types, the media sensor 130 or a corresponding media sensing system determines the media type of the print medium 14.

Figure 6:
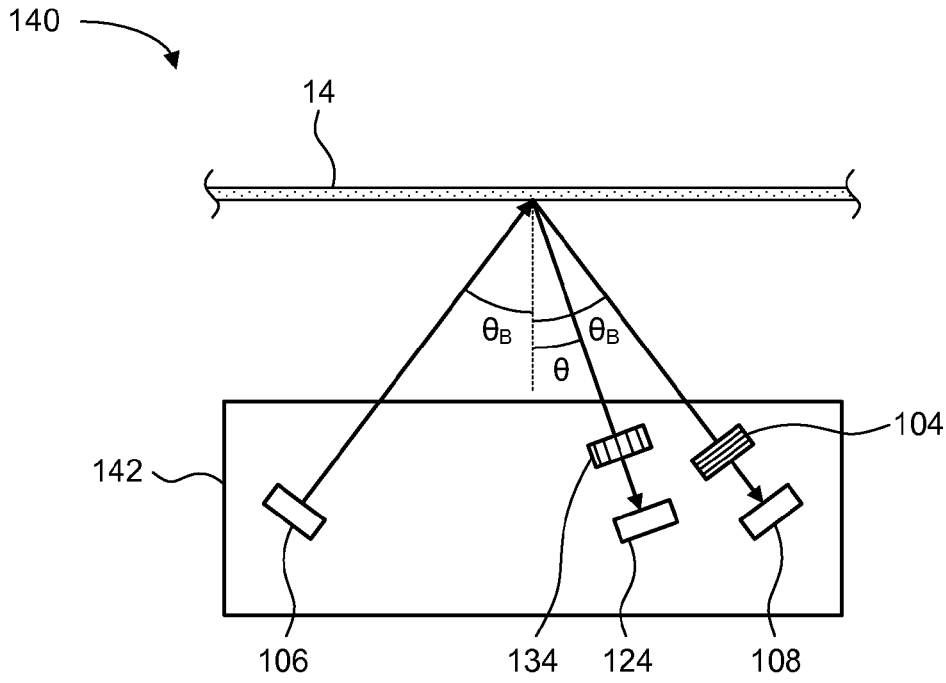
FIG. 6 depicts a schematic diagram of another embodiment of a media sensing system which implements a media sensor with multiple optical detectors at different reflectance angles.

FIG. 6 depicts a schematic diagram of another embodiment of a media sensing system 140 which implements a media sensor 142 with multiple optical detectors 108 and 124 at different reflectance angles. In many aspects, the illustrated media sensor 142 operates in a manner that is substantially similar to the media sensor 132 of FIG. 5. However, the optical detectors 108 and 124 and the corresponding polarization filters 104 and 134 are offset at different angles with respect to the angle of incidence and the surface normal of the print media 14.

In particular, the first optical detector 108 and corresponding polarization filter 104 are located and oriented to receive the reflected light at approximately the Brewster's angle, $\theta_B$, of the print medium 14. In contrast, the second optical detector 124 and the corresponding polarization filter 134 are located and oriented to receive the reflected light at an angle, $\theta$, that is different from the Brewster's angle of the print medium 14. In other words, the optical detectors 108 and 124 are at different angles, and are not adjacent to one another, within the specular and/or diffuse path of the reflected light.

By implementing multiple optical detectors 108 and 124 at different reflectance angles, the optical detectors 108 and 124 generate and output electrical signals with different ranges. By correlating the multiple output signals to known values for various media types, the media sensor 140 or a corresponding media sensing system determines the media type of the print medium 14. In other embodiments, more than two optical detectors 108 and 124 may be implemented. In other embodiments, one or more of the polarization filters 104 and 134 may be omitted.

Figure 7:
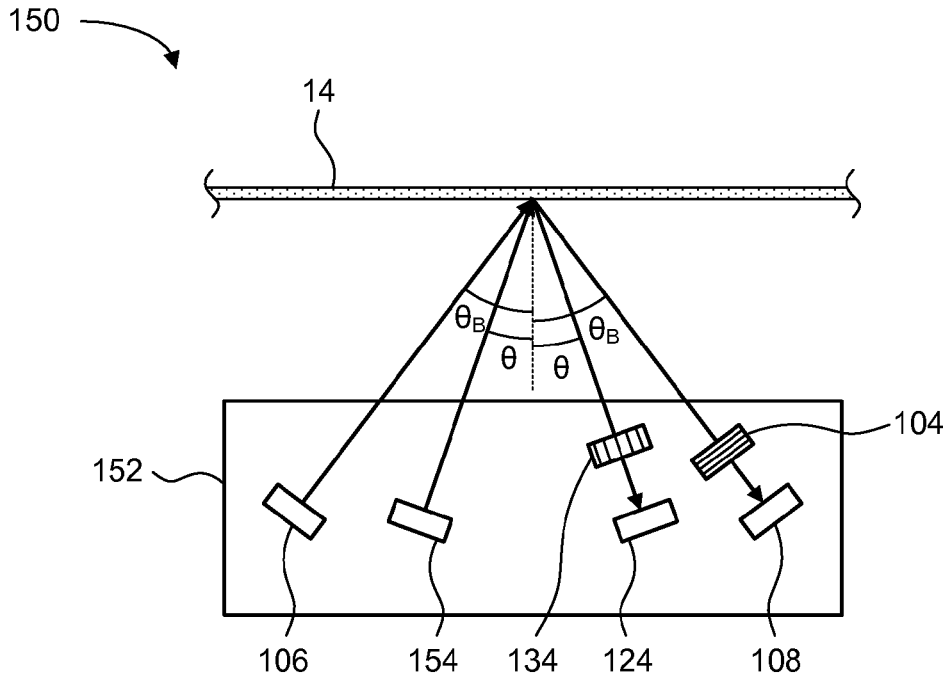
FIG. 7 depicts a schematic diagram of another embodiment of a media sensing system which implements a media sensor with multiple optical emitters.

FIG. 7 depicts a schematic diagram of another embodiment of a media sensing system 150 which implements a media sensor 152 with multiple optical emitters 106 and 154. In some embodiments, the optical emitters 106 and 154 are positioned relatively close (e.g., adjacent) to one another. In other embodiments, the optical emitters 106 and 154 are positioned at different angles of incidence such as the Brewster's angle, $\theta_B$, for the print medium 14 and another angle, $\theta$, as described above for the optical detectors 108 and 124.

Additionally, in some embodiments, the optical emitters 106 and 154 may have a one-to-one correlation with a corresponding number of optical detectors 108 and 124. In this implementation, the optical emitters 106 and 154 and optical detectors 108 and 124 may be positioned and oriented so that each of the optical detectors 108 and 124 receives only the reflected light from one of the corresponding optical emitters 106 and 154. For example, the optical detector 108 receives reflected light from the optical emitter 106, but does not receive reflected light from the optical emitter 154. Similarly, the optical detector 124 receives reflected light from the optical emitter 154, but does not receive reflected light from the optical emitter 106. This mutual exclusivity of the reflected lights detected by the optical detectors 108 and 124 may be implemented by the positioning and/or orientation of the optical detectors 108 and 124, or may be at least partially implemented by using physical structures (e.g., screen walls or light channels) to optically isolate the optical detectors 108 and 124.

By implementing multiple optical emitters 106 and 154 at the same or different angles of incidence, the optical detectors 108 and 124 generate and output electrical signals with different ranges. By correlating the multiple output signals to known values for various media types, the media sensor 152 or a corresponding media sensing system determines the media type of the print medium 14. In other embodiments, more than two optical emitters may be implemented. In other embodiments, one or more of the polarization filters 104 and 134 may be omitted.

Figure 8:
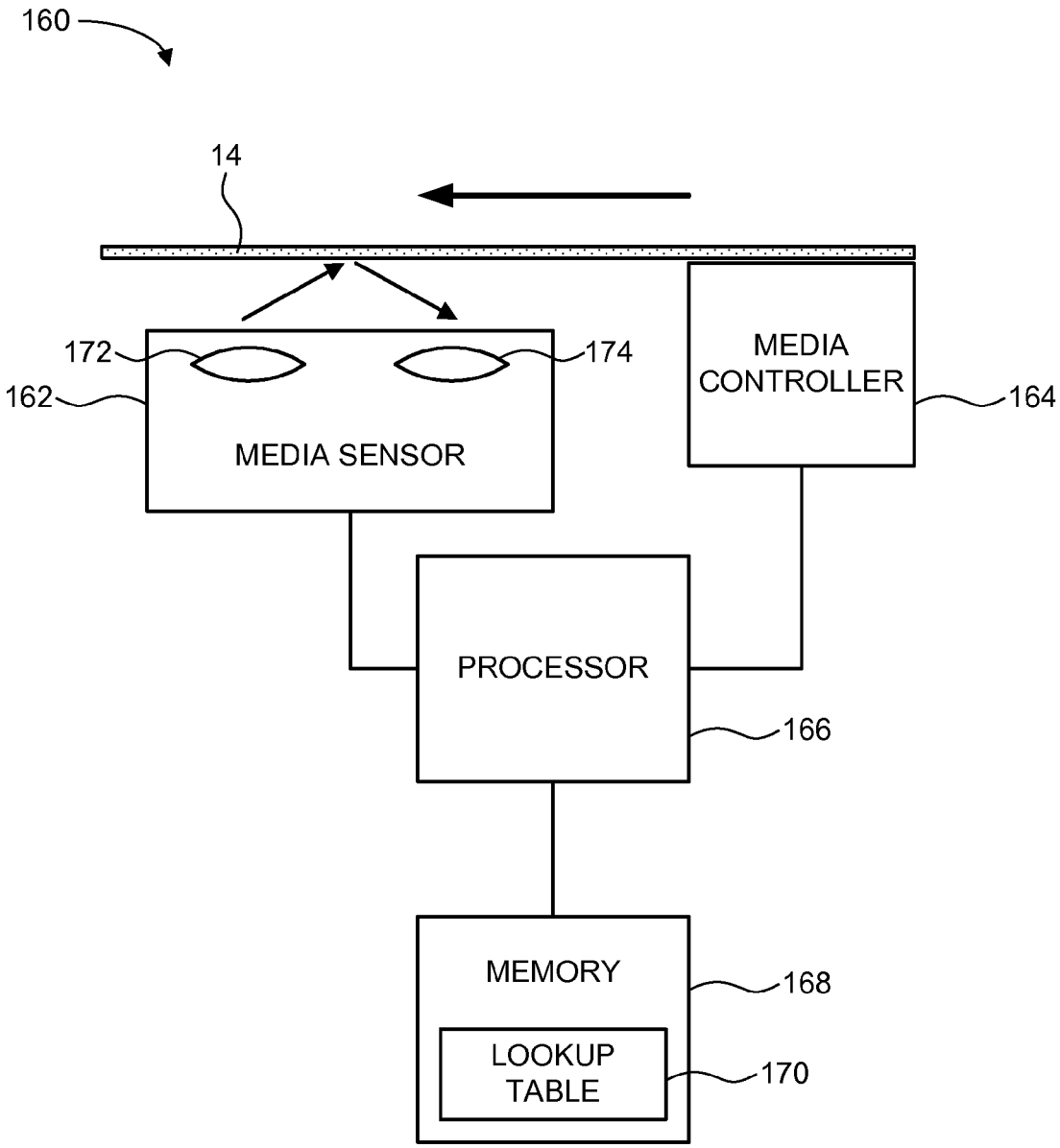
FIG. 8 depicts a schematic diagram of another embodiment of a media sensing system.

FIG. 8 depicts a schematic diagram of another embodiment of a media sensing system 160. The illustrated media sensing system 160 includes a media sensor 162, a media controller 164, a processor 166, and a memory device 168. The media sensor 162 is representative of any of the various embodiments of media sensors shown in FIGS. 2 and 4-7 and described above.

In one embodiment, one or more optical detectors 108 within the media sensor 162 generate a corresponding number of electrical signals. As described above, the electrical signals are generated in response to light incident on the optical detectors 108. In some instances, the optical detectors 108 or the media sensor 162 also may generate an electrical signal in response to the absence of incident light on at least one of the optical detectors 108.

The media sensor 162 is coupled to the processor 166 to send one or more of the electrical signals to the processor 166. Alternatively, the media sensor 162 may generate and send a different electrical signal, derived from one or more electrical signals from the optical detectors 108, to the processor 166. Upon receipt of the signal(s) from the media sensor 162, the processor 166 accesses a lookup table 170 in the memory device 168 to determine a media type of the print medium 14. The lookup table 170 may include values for different media types based on s-polarization measurements, p-polarization measurements, or measurements of unpolarized light, or combinations thereof. Additionally, combinations of the same measurement units taken at different locations, or angles, may be stored in the lookup table to provide a media type depending on a set of given input values. For example, a combination of s-polarization measurements from different optical detectors 108 may be used to look up the media type of the print medium 14.

In one embodiment, the processor 166 also manages the media controller 164. The media controller 164 is configured to advance the print medium 14 past the media sensor 162. As the print medium 14 advances past the media sensor 162, the media sensor 162 performs the functions described above in order to determine the media type of the print medium 14. In some embodiments, the media sensor 162 also includes one or more optical lenses 172 and 174 to determine the path of the incident light and the reflected light. For example, an emitter lens 172 may collimate the incident light at the surface of the print medium 14. Additionally, a detector lens 174 may focus the reflected light on the corresponding polarization filter 104 or optical detector 108.

In another embodiment, the illustrated media sensing system 160 is a system to identify a media type of a print medium 14. The media controller 164 is configured to feed the print medium 14 in a direction. The media sensor 162 is configured to generate an electrical signal indicative of the media type of the print medium 14. The electrical signal is based on at least a filtered component of polarized light reflected from a surface of the print medium 14 as the print medium 14 advances past the media sensor 162. The processing device 166 is coupled to the media sensor 162. The processing device 166 is configured to determine the media type of the print medium 14 based on the electrical signal from the media sensor 162. The processing device 166 is also configured to facilitate a print instruction specific to the media type of the print media 14. As an example, a print instruction to an inject printer may differ as to the amount of ink used for different types of print media 14 detected by the media sensor 162. In particular, more ink may be used for coated paper, compared to uncoated paper.

Figure 9:
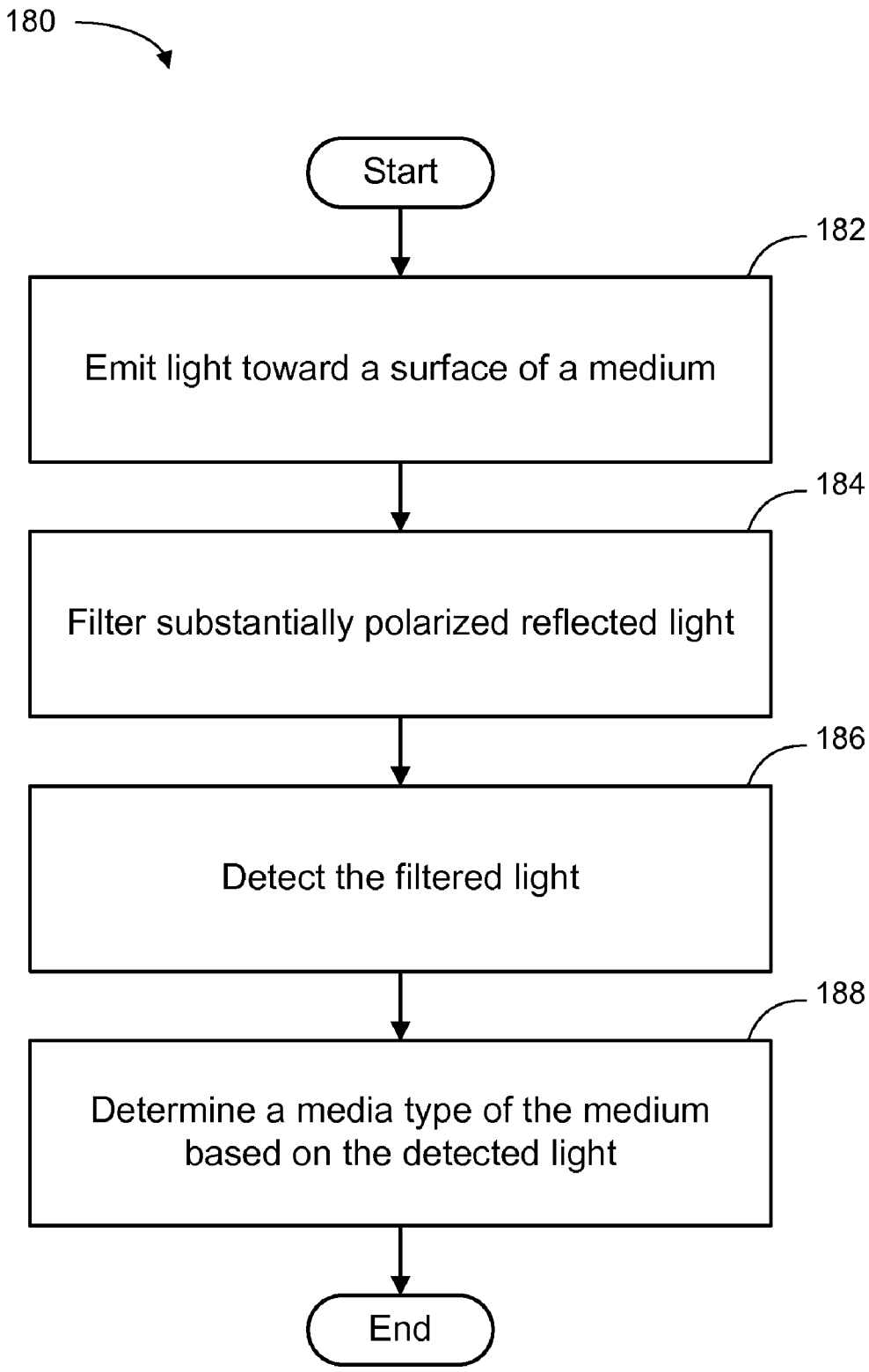
FIG. 9 depicts a schematic flow chart diagram of one embodiment of a method of operation for a media sensor having a polarization filter.

FIG. 9 depicts a schematic flow chart diagram of one embodiment of a method 180 of operation for a media sensor 102 having a polarization filter 104. Although the method 180 is described with reference to the media sensor 100 of FIG. 2 and the media sensing system 160 of FIG. 8, other embodiments of the method 180 may be implemented in conjunction with other media sensors and/or media sensing systems.

At block 182, the optical emitter 106 emits light toward a medium such as the print medium 14 described above. The print medium 14 may have a highly specular surface, a highly matte surface, or a surface with another type of reflectivity. As explained above, the reflective properties of the surface of the print medium 14 may depend on the refractive index and the roughness of the surface of the print medium 14. Depending on these reflective properties of the surface of the print medium 14, the incident light is reflected toward the polarization filter 104 and the corresponding optical detector 108.

At block 184, the polarization filter 104 filters substantially polarized light. As an example, the polarization filter 104 may block, or filter out, the s-polarized light component of the reflected light. Alternatively, the polarization filter 104 may filter out the p-polarized light component of the reflected light.

At block 186, the optical detector 108 detects the filtered light, assuming there is some portion of the reflected light that is passed by the polarization filter 104. Alternatively, if all of the reflected light is blocked by the polarization filter 104, then the optical detector 104 may either not generate a signal or may generate a signal indicative of the absence of detectable light at the optical detector 108.

At block 188, the processor 166 uses a signal from the optical detector 108, or a derivative thereof, to determine a media type of the print medium 14. In one embodiment, the processor 166 accesses a lookup table 170 stored in a memory device 168 to determine the media type of the print medium 14. The illustrated method 180 then ends.

Figure 10:
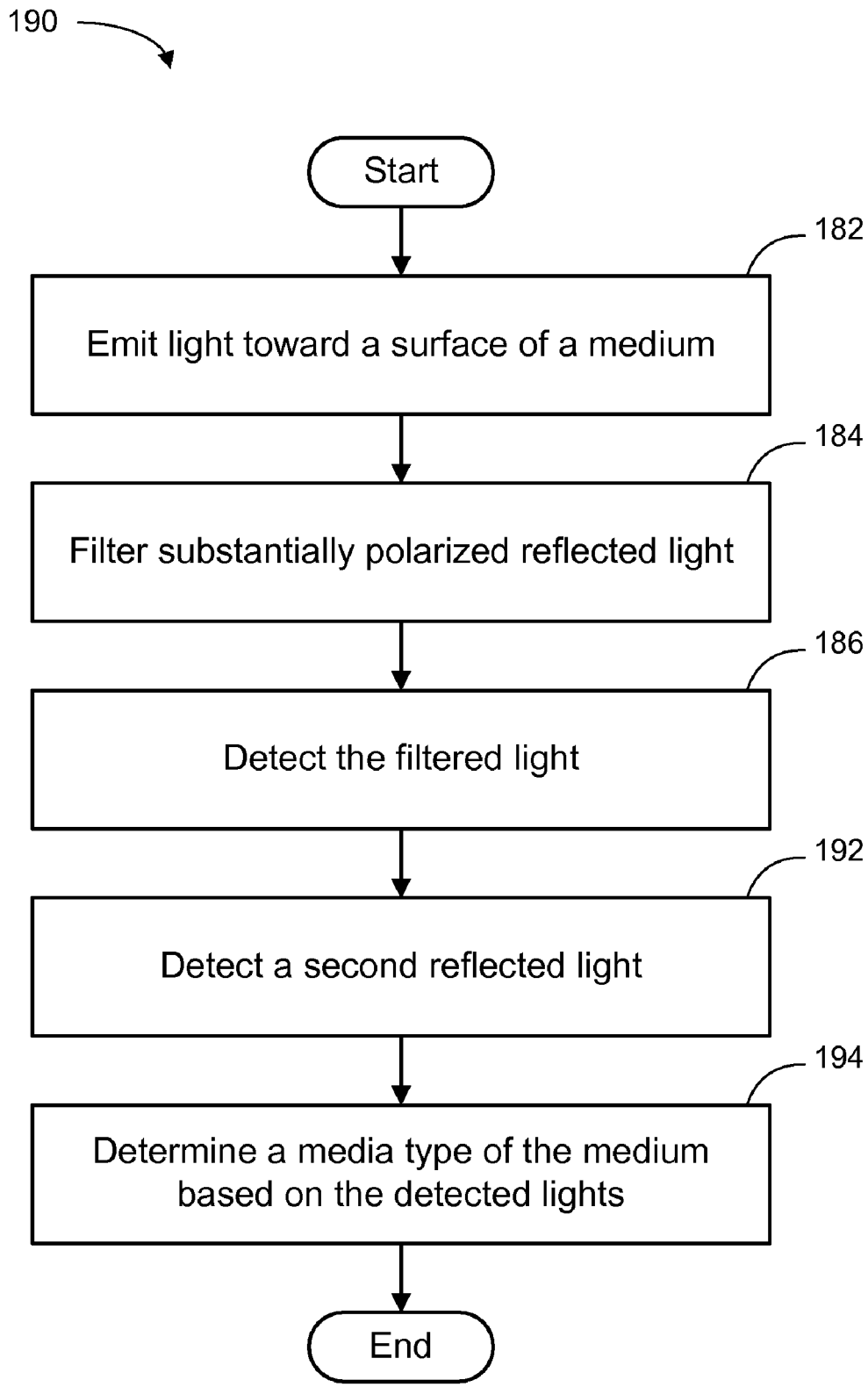
FIG. 10 depicts a schematic flow chart diagram of one embodiment of a method of operation for a media sensor having a polarization filter and multiple optical detectors.

FIG. 10 depicts a schematic flow chart diagram of one embodiment of a method 190 of operation for a media sensor 122 having a polarization filter 104 and multiple optical detectors 108 and 124. Although the method 190 is described with reference to the media sensor 122 of FIG. 4 and the media sensing system 160 of FIG. 8, other embodiments of the method 190 may be implemented in conjunction with other media sensors and/or media sensing systems. Also, it should be noted that at least some of the operations of the illustrated method 190 are substantially similar to the operations of the method 180 shown in FIG. 9 and described above. Hence, the descriptions of these operations are not repeated.

After the optical detector 108 detects the filtered light, at block 186, then at block 192 a second optical detector 124 detects a second reflected light. In one embodiment, the second reflected light originates from a second optical emitter 154, as shown in FIG. 7 and described in more detail above. Alternatively, the second reflected light may refer to a second component of the same reflected light from a single optical emitter 106. For example, the substantially s-polarized light component of a reflected light may serve as a first reflected light, while the p-polarized light component of the same reflected light may serve as a second light. Other embodiments may use other types of lights or light components as first and second lights.

At block 194, the processor 166 determines a media type of the print medium 14 based on the detected lights. In one embodiment, the processor 166 receives the electrical signals generated by the optical detectors 108 and 124, or signals derived from the electrical signals generated by the optical detectors 108 and 124, and computes an index value based on the detected lights. The processor 166 then determines a media type of the print medium 14 based on the computed index. In an alternative embodiment, the processor 166 may forego computing a single index and may determine the media type of the print medium 14 based on a plurality of signals from two or more optical detectors 108 and 124. The depicted method 190 then ends.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

Although specific embodiments of the invention have been described and illustrated, the invention is not to be limited to the specific forms or arrangements of parts so described and illustrated. The scope of the invention is to be defined by the claims appended hereto and their equivalents.

What is claimed is:

1. An apparatus for sensing a media type, the apparatus comprising:

an emitter to emit light toward a surface of a medium;

a polarization filter to filter polarized light reflected from the surface of the medium; and only one detector coupled to the polarization filter, the only one detector to detect the filtered light and to generate an electrical signal representative of the detected light wherein the electrical signal from the only one detector is the only signal for sensing the media type of the medium.

2. The apparatus of claim 1, wherein the emitter is further configured to emit light toward the surface of the medium at an angle of incidence approximately equal to Brewster's angle of the medium to polarize substantially all of the reflected light, and wherein the polarization filter and the only one detector are further configured to receive the reflected light at an angle of reflection approximately equal to the Brewster's angle of the medium.

3. The apparatus of claim 2, wherein the polarization filter is oriented relative to the emitter and the surface of the medium to filter out substantially all of the polarized light.

4. The apparatus of claim 1, wherein an amplitude of the electrical signal is indicative of the media type of the medium.

5. The apparatus of claim 1, further comprising:

an emitter lens coupled to the emitter, the emitter lens to collimate the light from the emitter toward the surface of the medium; and a detector lens coupled to the only one detector, the detector lens to focus the polarized light on the polarization filter.

6. An apparatus for sensing a media type, the apparatus comprising:

an emitter to emit light toward a surface of a medium;

a polarization filter to filter polarized light reflected from the surface of the medium;

a first detector coupled to the polarization filter, the first detector to detect the filtered light and to generate an electrical signal representative of the detected light; and a second detector to detect polarized light reflected from the surface of the medium, wherein the first detector and the second detector are located at approximately a common specular reflection path relative to the surface of the medium.

7. The apparatus of claim 6, wherein the emitter is further configured to emit the light toward the surface of the medium at an angle of incidence approximately equal to Brewster's angle of the medium to polarize substantially all of the reflected light, and wherein the polarization filter and the first detector and the second detector are further configured to receive the reflected light at an angle of reflection approximately equal to the Brewster's angle of the medium.

8. The apparatus of claim 6, wherein the polarization filter is oriented relative to the emitter and the surface of the medium to filter out substantially all of the polarized light.

9. The apparatus of claim 6, wherein an amplitude of the electrical signal is indicative of the media type of the medium.

10. The apparatus of claim 6, wherein the apparatus further comprises a second polarization filter coupled to the second detector, the second polarization filter to filter the reflected light from the surface of the medium, wherein the second polarization filter and the second detector are further configured to receive the reflected light at an angle of reflection other than the Brewster's angle of the medium, and wherein the polarization filter is oriented relative to the emitter and the medium to filter out substantially all of the polarized light, and wherein the second polarization filter is oriented relative to the emitter and the medium to pass substantially all of the light incident on the second polarization filter.

11. The apparatus of claim 6, wherein the second detector is further configure to generate a second electrical signal representative of the light detected by the second detector.

12. The apparatus of claim 6, further comprising a second emitter to emit a second light toward the surface of the medium, wherein the second emitter is further configured to emit the second light toward the surface of the medium at an angle of incidence other than the Brewster's angle of the medium.

13. The apparatus of claim 6, further comprising:

an emitter lens coupled to the emitter, the emitter lens to collimate the light from the emitter toward the surface of the medium; and a detector lens coupled to the detector, the detector lens to focus the polarized light on the polarization filter.

14. An apparatus for sensing a media type, the apparatus comprising:

an emitter to emit light toward a surface of a medium;

a first detector to detect a filtered light and to generate an electrical signal representative of the detected light;

a second detector to detect a second reflected light reflected from the surface of the medium;

a first polarization filter coupled to the first detector, the first polarization filter to filter polarized light reflected from the surface of the medium, wherein the first polarization filter is oriented relative to the emitter and the medium to filter out substantially all of the polarized light; and a second polarization filter coupled to the second detector, the second polarization filter to filter the second reflected light from the surface of the medium, wherein the second polarization filter and the second detector are further configured to receive the second reflected light at an angle of reflection other than Brewster's angle of the medium, wherein the second polarization filter is oriented relative to the emitter and the medium to pass substantially all of the second reflected light.

15. The apparatus of claim 14, wherein the emitter is further configured to emit light toward the surface of the medium at an angle of incidence approximately equal to the Brewster's angle of the medium to polarize substantially all of the reflected light, and wherein the first polarization filter and the first detector are further configured to receive the reflected light at an angle of reflection approximately equal to the Brewster's angle of the medium.

16. The apparatus of claim 14, wherein the first polarization filter is oriented relative to the emitter and the surface of the medium to filter out substantially all of the polarized light.

17. The apparatus of claim 14, wherein an amplitude of the electrical signal is indicative of the media type of the medium.

18. The apparatus of claim 14, wherein the second detector is further configured to generate a second electrical signal representative of the second reflected light.

19. The apparatus of claim 14, further comprising a second emitter to emit a second light toward the surface of the medium, wherein the second emitter is further configured to emit the second light toward the surface of the medium at an angle of incidence other than the Brewster's angle of the medium.

20. The apparatus of claim 14, further comprising:

an emitter lens coupled to the emitter, the emitter lens to collimate the light from the emitter toward the surface of the medium; and a detector lens coupled to the detector, the detector lens to focus the polarized light on the first polarization filter.

* * * * *